US005338893A

United States Patent [19]

Edmunds et al.

[11] Patent Number: 5,338,893

[45] Date of Patent: Aug. 16, 1994

[54] DONOR ROLL WITH ELECTRODE SPACER FOR SCAVENGELESS DEVELOPMENT IN A XEROGRAPHIC APPARATUS

[75] Inventors: Cyril G. Edmunds; Gerald T. Lioy, both of Webster, N.Y.

[73] Assignee: Xerox Corporation, Stamford, Conn.

[21] Appl. No.: 106,744

[22] Filed: Aug. 16, 1993

[51] Int. Cl.[5] ..... G03G 15/08

[52] U.S. Cl. ..... 118/647; 355/247; 355/259

[58] Field of Search ..... 118/647, 654; 355/247, 355/259

[56] References Cited

U.S. PATENT DOCUMENTS

| | | | |
|---|---|---|---|
| 4,868,600 | 9/1987 | Hays et al. | 355/259 |
| 5,124,749 | 6/1992 | Bares | 355/202 |
| 5,144,370 | 9/1992 | Bares | 355/247 |
| 5,153,647 | 10/1992 | Barker et al. | 355/245 |
| 5,153,648 | 10/1992 | Lioy et al. | 355/247 |
| 5,194,905 | 3/1993 | Brewington | 355/326 |
| 5,206,693 | 4/1993 | Folkins | 355/261 |
| 5,245,392 | 9/1993 | Behe et al. | 355/259 |
| 5,253,016 | 10/1993 | Behe et al. | 355/215 |
| 5,270,483 | 12/1993 | Inoue et al. | 118/647 |

FOREIGN PATENT DOCUMENTS 5-35065 2/1993 Japan .

*Primary Examiner*—R. L. Moses
*Attorney, Agent, or Firm*—R. Hutter

[57] ABSTRACT

In a scavengeless development apparatus, an electrode wire is disposed between a donor roll and a latent image to form a powder cloud of toner to develop the latent image. The donor roll includes a section of increased diameter spaced away from the latent image, and the electrode wire is disposed in sliding contact with the section of increased diameter to obtain a consistent spacing from the main length of the donor roll.

10 Claims, 4 Drawing Sheets

DONOR ROLL WITH ELECTRODE SPACER FOR SCAVENGELESS DEVELOPMENT IN A XEROGRAPHIC APPARATUS

The present invention relates to developer apparatus for electrophotographic printing. More specifically, the invention relates to controlling the spacing of an electrode wire relative to a donor roll in a scavengeless development process.

In the well-known process of electrophotographic printing, a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as "toner." Toner is held on the image areas by the electrostatic charge on the photoreceptor surface. Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

In the process of electrophotographic printing, the step of conveying toner to the latent image on the photoreceptor is known as "development". The object of effective development of a latent image on the photoreceptor is to convey toner particles to the latent image at a controlled rate so that the toner particles effectively adhere electrostatically to the charged areas on the latent image. A commonly used technique for development is the use of a two-component developer material, which comprises, in addition to the toner particles which are intended to adhere to the photoreceptor, a quantity of magnetic carrier beads. The toner particles adhere triboelectrically to the relatively large carrier beads, which are typically made of steel. When the developer material is placed in a magnetic field, the carrier beads with the toner particles thereon form what is known as a magnetic brush, wherein the carrier beads form relatively long chains which resemble the fibers of a brush. This magnetic brush is typically created by means of a "transport" roll. The transport roll is typically in the form of a cylindrical sleeve rotating around a fixed assembly of permanent magnets. The carrier beads form chains extending from the surface of the transport roll, and the toner particles are electrostatically attracted to the chains of carrier beads. When the magnetic brush is introduced into a development zone adjacent the electrostatic latent image on a photoreceptor, the electrostatic charge on the photoreceptor will cause the toner particles to be pulled off the carrier beads and onto the photoreceptor.

Another known development technique involves a single-component developer, that is, a developer which consists entirely of toner. In a common type of single-component system, each toner particle has both an electrostatic charge (to enable the particles to adhere to the photoreceptor) and magnetic properties (to allow the particles to be magnetically conveyed to the photoreceptor). Instead of using magnetic carrier beads to form a magnetic brush, the magnetized toner particles are caused to adhere directly to a transport roll. In the development zone adjacent the electrostatic latent image on a photoreceptor, the electrostatic charge on the photoreceptor will cause the toner particles to be pulled from the developer to the photoreceptor. (As used in the claims herein, the phrase "developer material" shall be construed to mean either single-component or two-component developer material, or a portion thereof, such as the toner separated from the two-component developer material on a magnetic brush.)

An important variation to the general principle of development is the concept of "scavengeless" development. The purpose and function of scavengeless development are described more fully in, for example, U.S. Pat. No. 4,868,600. In a scavengeless development system, toner is made available to the photoreceptor by means of AC electric fields supplied by self-spaced electrode structures, commonly in the form of wires extending across the photoreceptor, positioned within the nip between a donor roll and photoreceptor. Because there is no physical contact between the development apparatus and the photoreceptor, scavengeless development is useful for devices in which different types of toner are supplied onto the same photoreceptor, as in "tri-level" or "recharge, expose, and develop" highlight or image-on-image color xerography.

A typical "hybrid" scavengeless development apparatus includes, within a developer housing, a transport roll, a donor roll, and an electrode structure. The transport roll operates in a manner similar to a transport roll, but instead of conveying toner directly to the photoreceptor, conveys toner to a donor roll disposed between the transport roll and the photoreceptor. The transport roll is electrically biased relative to the donor roll, so that the toner particles are attracted from the transport roll to the donor roll. The donor roll further conveys toner particles from the transport roll toward the photoreceptor. In the nip between the donor roll and the photoreceptor are the wires forming the electrode structure. During development of the latent image on the photoreceptor, the electrode wires are AC-biased relative to the donor roll to detach toner therefrom so as to form a toner powder cloud in the gap between the donor roll and the photoreceptor. The latent image on the photoreceptor attracts toner particles from the powder cloud, forming a toner powder image thereon.

Another variation on scavengeless development is single-component scavengeless development, also known as scavengeless SCD. In scavengeless SCD, the donor roll and the electrode structure create a toner powder cloud in the same manner as the above-described scavengeless development, but instead of using a magnetic brush to convey toner particles from the toner supply in the developer housing to the donor roll, a portion of the donor roll is exposed directly to a supply of single-component developer, which is pure toner. Scavengeless SCD provides the same advantages as the basic case of hybrid scavengeless development, and is useful in situations where the size, weight, or power consumption of the apparatus is of particular concern.

One problem with prior art arrangements of scavengeless development stations having one or more electrode wires disposed along the length of the donor roll between the donor roll and the surface of the photoreceptor is that ensuring a consistent spacing of the electrode wire or wires for the full length of the donor roll may be inconvenient over a sizable production run. The electrode wire must be of a consistent spacing along the length of the donor roll to ensure a uniform electric field across the entire photoreceptor. If the electrode wire at one end of the donor roll is higher or lower than the other end relative to the surface of the donor roll, there will expectably be a significant difference in quality of development on the different ends of the donor roll, with ultimately noticeable results on prints made with the developer system. It is therefore crucial that means for ensuring a uniform spacing of the donor roll surface, electrode wire or wires, and the photoreceptor be provided; it is just as crucial that any means for ensuring this consistent spacing be amenable to a straightforward manufacturing process so that numerous development stations can be mass-produced with minimal manual adjustment of each finished product.

U.S. Pat. No. 5,144,370 discloses a technique of eliminating unwanted mechanical vibration of electrode wires in scavengeless apparatus. The vibration of the electrode wires is detected by a vibration detector such as a microphone. The vibrational signal from this microphone is then phase-shifted, and a mechanically compensating mechanical vibration is reintroduced into the electrode wire, to cancel out the natural vibration.

According to the present invention, there is provided an apparatus for developing an electrostatic latent image on a charge receptor. A housing defines a chamber for storing a supply of developer material therein. A donor roll is mounted at least partially in the chamber of the housing, to advance developer material to the development zone to develop the latent image. The donor roll includes a region of increased diameter spaced from the development zone. An electrode wire is positioned between the latent image and the donor roll, the electrode wire being electrically biased to detach toner particles from the donor roll so as to form a toner powder cloud in the development zone with detached toner particles from the toner cloud developing the latent image. A portion of the electrode wire is held in sliding contact with the region of increased diameter of the donor roll, to maintain the electrode wire at a substantially constant spacing from the donor roll.

Inasmuch as the art of electrophotographic printing is well known, the various processing stations employed in the FIG. 5 printing machine will be shown hereinafter schematically and their operation described briefly with reference thereto.

Figure 3:
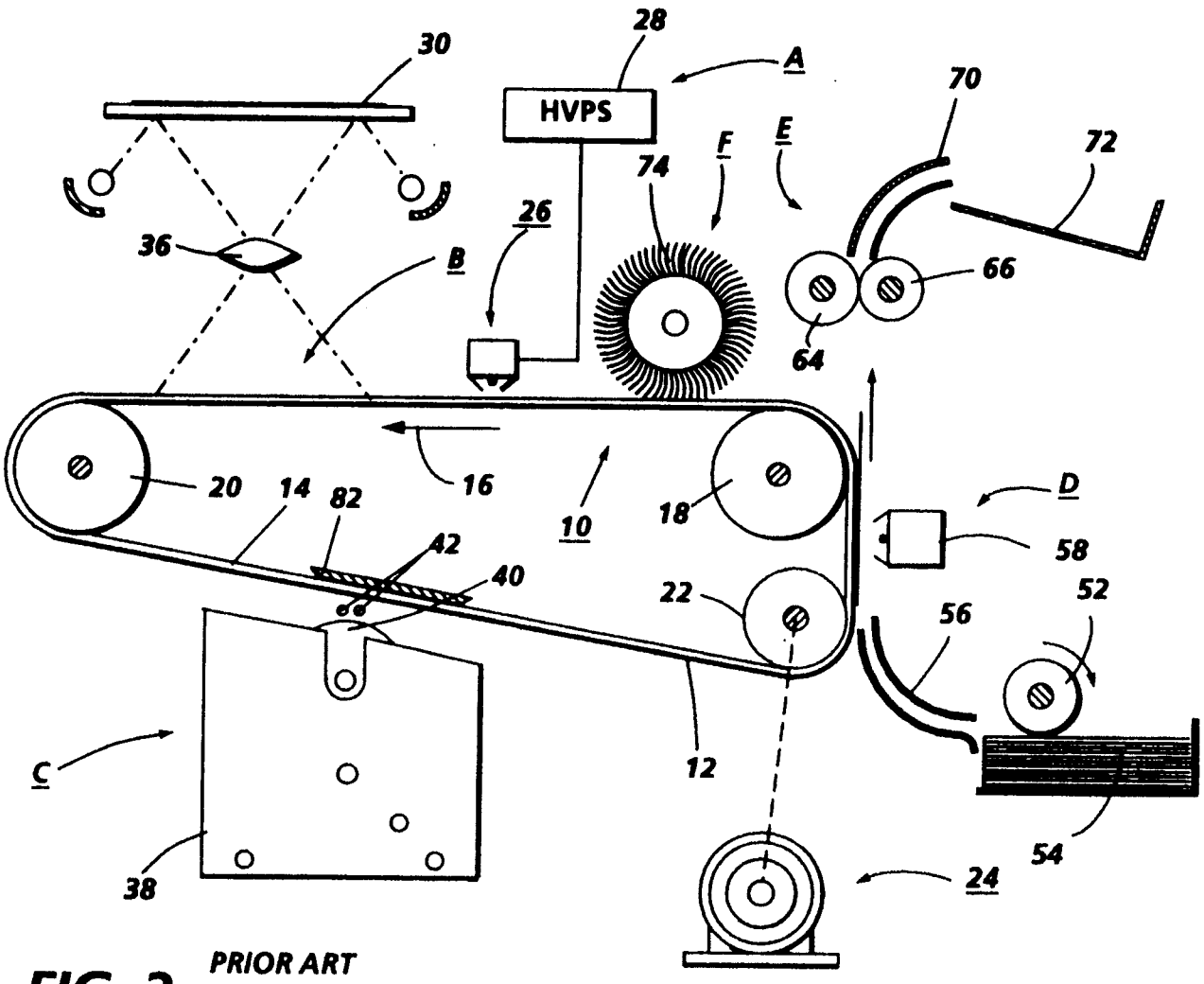
FIG. 3 PRIOR ART
FIG. 3 is an elevational view of an electrophotographic printing apparatus in which the present invention may be embodied.

Referring initially to FIG. 3, there is shown an illustrative electrophotographic printing machine incorporating the development apparatus of the present invention therein. The printing machine incorporates a photoreceptor 10 in the form of a belt having a photoconductive surface layer 12 on an electroconductive substrate 14. Preferably the surface 12 is made from a selenium alloy. The substrate 14 is preferably made from an aluminum alloy which is electrically grounded. The belt is driven by means of motor 24 along a path defined by rollers 18, 20 and 22, the direction of movement being counter-clockwise as viewed and as shown by arrow 16. Initially a portion of the belt 10 passes through a charge station A at which a corona generator 26 charges surface 12 to a relatively high, substantially uniform, potential. A high voltage power supply 28 is coupled to device 26. After charging, the charged area of surface 12 is passed to exposure station B.

At exposure station B, an original document 30 is placed face down upon a transparent platen 32. Lamps 34 flash light rays onto original document 30. The light rays reflected from original document 30 are transmitted through lens 36 to form a light image thereof. Lens 36 focuses this light image onto the charged portion of photoconductive surface 12 to selectively dissipate the charge thereon. This records an electrostatic latent image on photoconductive surface 12 which corresponds to the informational areas contained within original document 30.

After the electrostatic latent image has been recorded on photoconductive surface 12, belt 10 advances the latent image to development station C. At development station C, a development system housed in housing 38 develops the latent image recorded on the photoconductive surface. Preferably, development system includes a donor roller 40 and electrode wires positioned in the gap between the donor roll and photoconductive belt. Electrode wires 42 are electrically biased relative to donor roll 40 to detach toner therefrom so as to form a toner powder cloud in the gap between the donor roll and photoconductive surface. The latent image attracts toner particles from the toner powder cloud forming a toner powder image thereon. Donor roll 40 is mounted, at least partially, in the chamber of developer housing 44. The chamber in developer housing 44 stores a supply of developer material. The developer material is a two component developer material of at least magnetic carrier granules having toner particles adhering triboelectrically thereto. A transport roller disposed interiorly of the chamber of housing 38 conveys the developer material to the donor roller. The transport roller is electrically biased relative to the donor roller so that the toner particles are attracted from the transport roller to the donor roller. A permanent magnet 100 is disposed on the side of the photoreceptor 100 opposite that of electrode wires 42, and causes the wires 42 to be encompassed in a magnetic field. The development apparatus will be discussed hereinafter, in greater detail, with reference to FIG. 3.

After the electrostatic latent image has been developed, belt 10 advances the developed image to transfer station D, at which a copy sheet 54 is advanced by roll 52 and guides 56 into contact with the developed image on belt 10. A corona generator 58 is used to spray ions on to the back of the sheet so as to attract the toner image from belt 10 to the sheet. As the belt turns around roller 18, the sheet is stripped therefrom with the toner image thereon.

After transfer, the sheet is advanced by a conveyor (not shown) to fusing station E. Fusing station E includes a heated fuser roller 64 and a back-up roller 66. The sheet passes between fuser roller 64 and back-up roller 66 with the toner powder image contacting fuser roller 64. In this way, the toner powder image is permanently affixed to the sheet. After fusing, the sheet advances through chute 70 to catch tray 72 for subsequent removal from the printing machine by the operator.

After the sheet is separated from photoconductive surface 12 of belt 10, the residual toner particles adhering to photoconductive surface 12 are removed therefrom by a rotatably mounted fibrous brush 74 in contact with photoconductive surface 12. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present invention therein.

Figure 4:
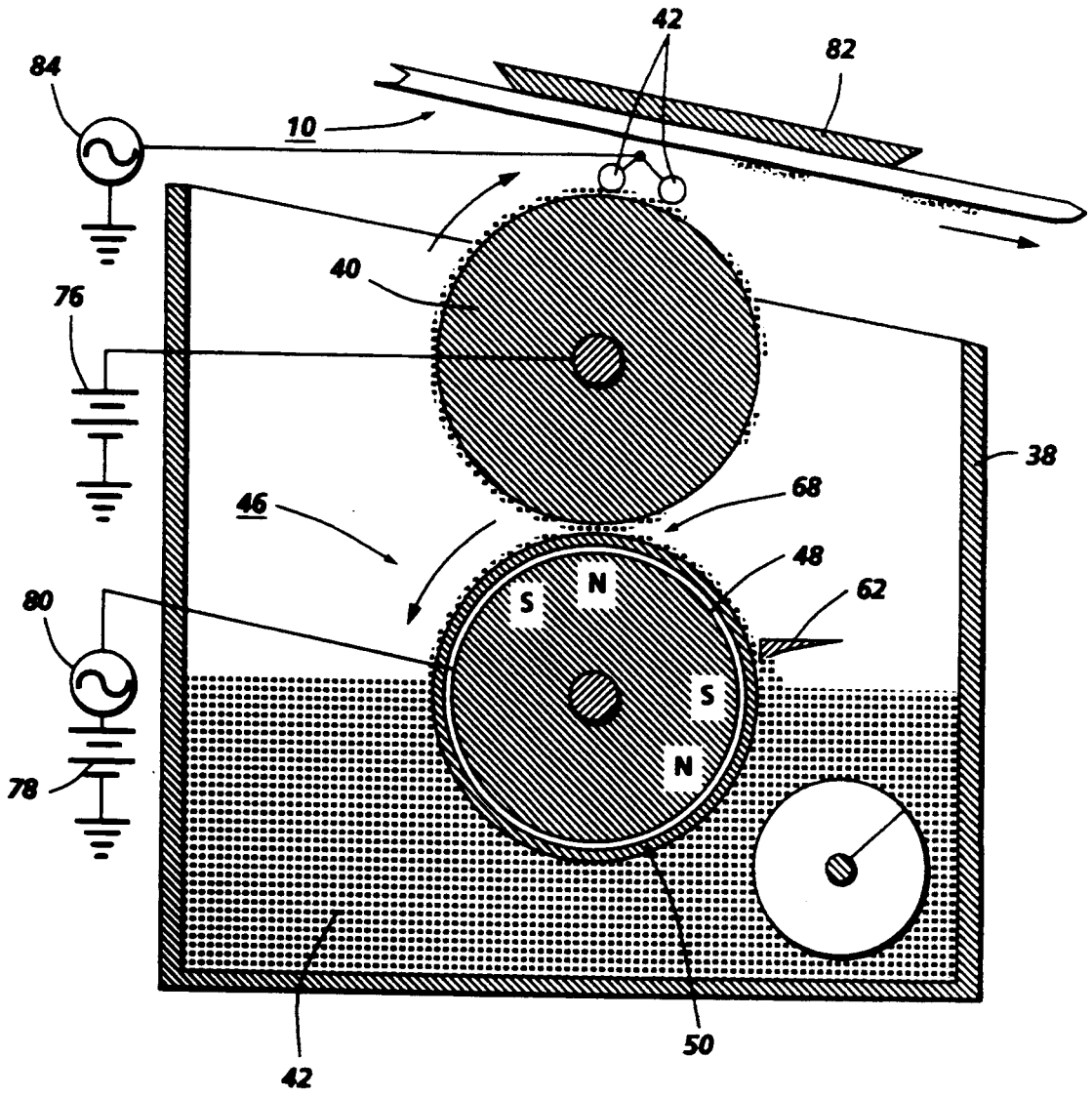
FIG. 4 PRIOR ART
FIG. 4 is a simplified elevational view of a hybrid scavengeless development station.

Referring now to FIG. 4, there is shown a hybrid-scavengeless development system in greater detail. Housing 38 defines a chamber for storing a supply of developer material 47 therein. Positioned in the bottom of housing 38 is a horizontal auger which distributes developer material uniformly along the length of transport roll 46, so that the lowermost part of roll 46 is always immersed in a body of developer material.

Transport roll 46 comprises a stationary multi-polar magnet 48 having a closely spaced sleeve 50 of non-magnetic material, preferably aluminum, designed to be rotated about the magnetic core 48 in a direction indicated by the arrow. Because the developer material includes magnetic carrier granules, the effect of the sleeve rotating through stationary magnetic fields is to cause developer material to be attracted to the exterior of the sleeve. A doctor blade 62 is used to limit the radial depth of developer remaining adherent to sleeve 50 as it rotates to the nip 68 between transport roll 46 and donor roll 40. The donor roll is kept at a specific voltage, by a DC power supply 76, to attract a thin layer of toner particles from transport roll 46 in nip 68 to the surface of donor roll 40. Either the whole of the donor roll 40, or at least a peripheral layer thereof, is preferably of material which has low electrical conductivity, as will be explained in detail below. The material must be conductive enough to prevent any build-up of electric charge with time, and yet its conductivity must be low enough to form a blocking layer to prevent shorting or arcing of the magnetic brush to the donor roll.

Transport roll 46 is biased by both a DC voltage source 78 and an AC voltage source 80. The effect of the DC electrical field is to enhance the attraction of developer material to sleeve 50. It is believed that the effect of the AC electrical field applied along the transport roll in nip 68 is to loosen the toner particles from their adhesive and triboelectric bonds to the carrier particles. AC voltage source 80 can be applied either to the transport roll as shown in FIG. 4, or directly to the donor roll in series with supply 76.

Electrode wires 42 are disposed in the space between the belt 10 and donor roll 40. A pair of electrode wires are shown extending in a direction substantially parallel to the longitudinal axis of the donor roll 40. The electrode wires are made from of one or more thin (i.e. 50 to 100 μm diameter) steel or tungsten wires which are closely spaced from donor roll 40. The distance between the wires and the donor roll 40 is approximately 25 μm or the thickness of the toner layer formed on the donor roll 40. The wires are self-spaced from the donor roller by the thickness of the toner on the donor roller. To this end the extremities of the wires supported by the tops of end bearing blocks also support the donor roller for rotation. The wire extremities are attached so that they are slightly below a tangent to the surface, including toner layer, of the donor structure. Mounting the wires in such a manner makes them insensitive to roll runout due to their self-spacing. An alternating electrical bias is applied to the electrode wires by an AC voltage source 84. The applied AC establishes an alternating electrostatic field between the wires and the donor roller which is effective in detaching toner from the surface of the donor roller and forming a toner cloud about the wires, the height of the cloud being such as not to be substantially in contact with the belt 10.

At the region where the photoconductive belt 10 passes closest to donor roll 40, a stationary shoe 82 bears on the inner surface of the belt. The position of the shoe relative to the donor roll establishes the spacing between the donor roll and the belt. The position of the shoe is adjustable and it is positioned so that the spacing between the donor roll and photoconductive belt is preferably about 0.4 mm. Behind shoe 82 on the side thereof opposite the photoreceptor 10 is a permanent magnet 100, which is intended to provide a magnetic field which effectively encompasses the wires 42. The precise function of the magnet 100 in the context of the claimed invention will be described in detail below.

Another factor which has been found to be of importance is the speed with which the sleeve 50 is rotated relative to the speed of rotation of donor roll 40. In practice both would be driven by the same motor, but a gear train would be included in the drive system so that sleeve 50 is driven at a significantly faster surface velocity than is donor roll 40. A transport roll:donor roll speed ratio of 3:1 has been found to be particularly advantageous, and even higher relative speeds might be used in some embodiments of the invention. In other embodiments the speed ratio may be as low as 2:1.

Figure 5:
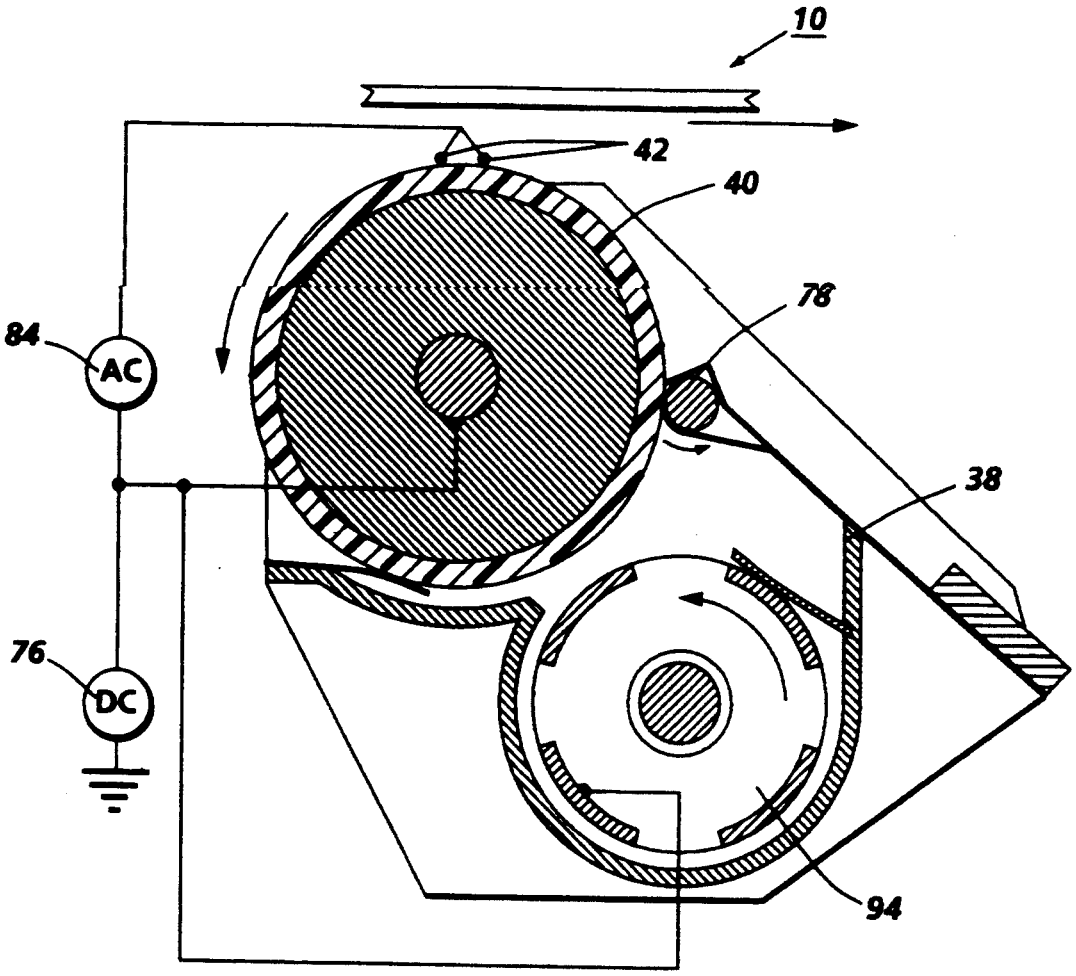
FIG. 5 PRIOR ART
FIG. 5 is a sectional elevational view of a single-component scavengeless development station.

FIG. 5 is a simplified plan view of a single-component scavengeless development station. In FIGS. 4 and 5, like reference numerals indicate like elements. As in the hybrid system of FIG. 4, the single-component system includes a donor roll 40 and electrode wires 42, but the donor roll 40 picks up toner to convey to the photoreceptor 10 directly from a supply of pure toner in the housing 38. In the single-component system of FIG. 5, there is no transport roll and therefore no carrier beads are used in the developer. The specific design of the developer station in FIG. 5 may include special items useful in single-component developing, such as a charging rod 78 or electrically biased toner mover 94, the precise function of which is described in the above-referenced patent.

Figure 1:
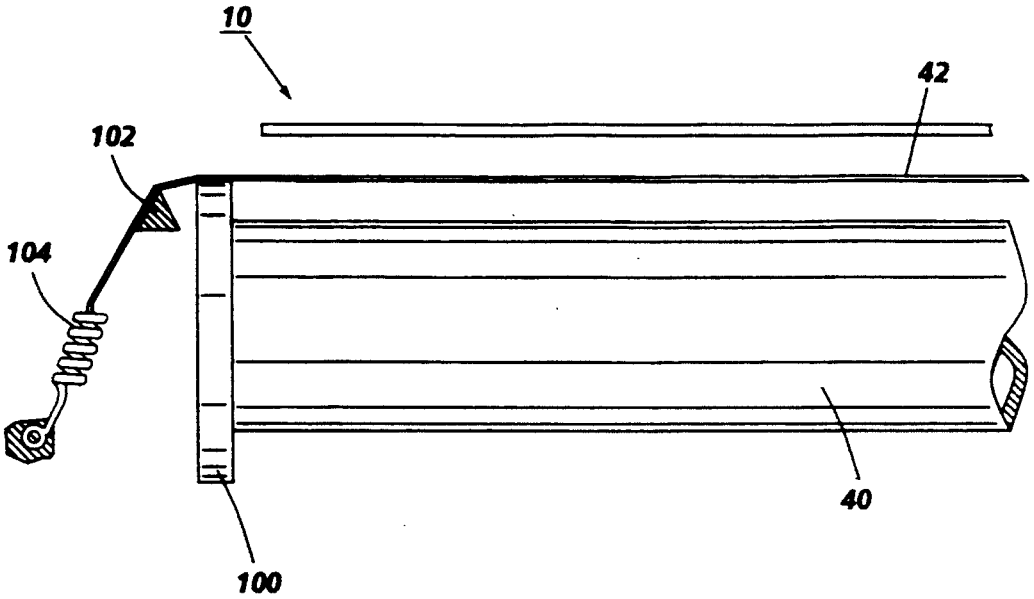
FIG. 1 is an elevational view showing certain elements of a single-component scavengeless development system incorporating the present invention.

FIG. 1 is an elevational view showing a portion of a scavengeless development system incorporating the present invention. The donor roll 40 is, as mentioned above, adapted to advance a uniform layer of toner particles thereon as it rotates toward a development zone around electrode wire 42. Electrode wire 42 extends substantially the length of the donor roll 40 between the donor roll 40 and the latent image on photoreceptor 10. In the view of FIG. 1, the motion of photoreceptor 10 is orthogonal to the surface of the page. According to the present invention, there is defined at at least one end of donor roll 40, spaced away from the development zone between the main surface of donor roll 40 and the photoreceptor 10, a section of increased diameter integral with the donor roll and indicated as ring 100. The purpose of ring 100 is to provide consistent spacing of the electrode wire 42 from the surface of donor roll 40 for most of the length thereof. The electrode wire 42 (which may be one of several parallel wires, depending on the system)is held in sliding contact with the outer surface of ring 100 so that, when donor roll 40 rotates, electrode wire 42 is retained in substantially the same position relative to the donor roll itself, as the outer surface of the donor roll is moved to advance a further supply of toner particles to the development zone. In order to maintain this sliding contact between the electrode wire 42 and ring 100, there is typically provided a bridge 102, preferably having a groove therein (not shown) for retaining the position of the electrode wire, much in the manner of a bridge for a stringed musical instrument. In order to urge the electrode wires against the outer surface of ring 100 and also the bridge 102, there may be provided some sort of tension mechanism, such as coil spring 104. However, it will be apparent to one skilled in the art that any number of means for retaining the sliding contact of electrode wire 42 against the ring 100 could be provided.

The bridge 102, or any equivalent means for retaining the position of one or more electrode wires 102, may be disposed as needed interior or exterior of the developer housing 38, according to a given design.

The preferred material for donor roll 40 is aluminum, which may or may not include some sort of insulative or semiconductive outer coating to improve the specific desire electrical properties of the donor roll. However, at the present time, the preferred process for manufacture of donor rolls is to use diamond turning to obtain a base aluminum roll of a precise diameter. Further, with diamond turning, the diameter of the ring 100 may be adjusted relative to the main diameter of roll 40 within a few microns. The preferred increase in diameter for the ring 100, which in turn directly affects the spacing of the electrode wire 42 from the main portion of donor roll 40, is 25 microns; thus the ring diameter should be about 50 microns bigger than the diameter of the rest of the donor roll 40.

Figure 2:
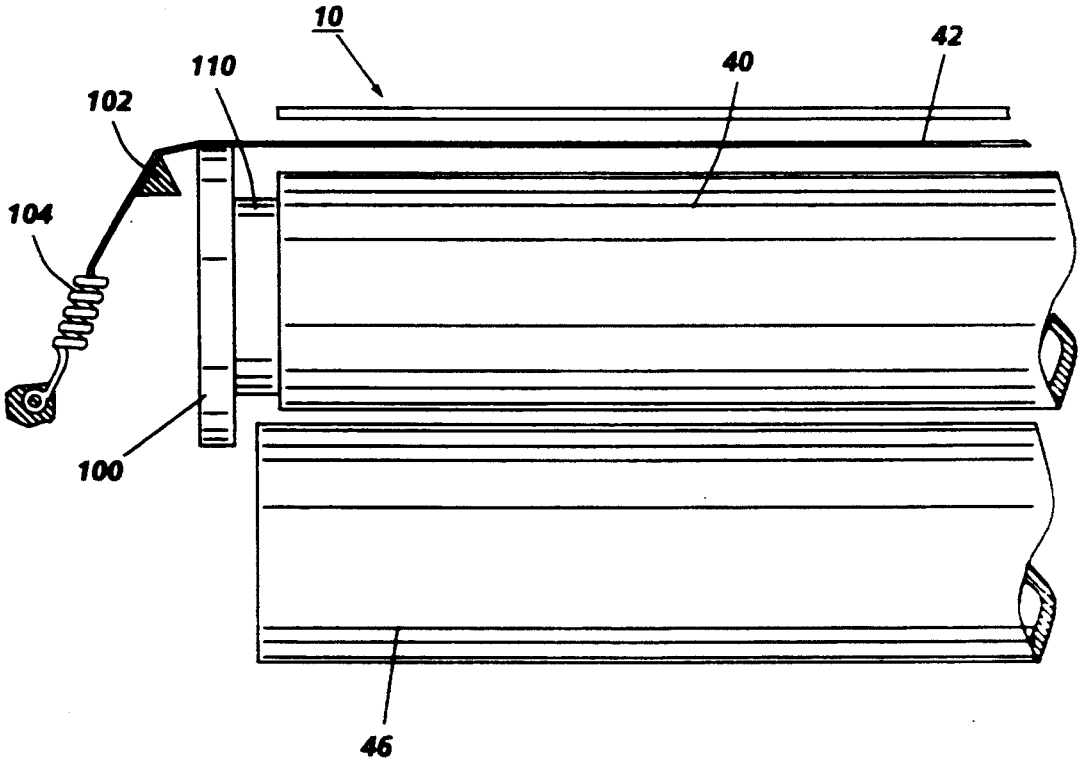
FIG. 2 is an elevational view showing certain elements of a hybrid scavengeless development system incorporating the present invention.

FIG. 2 is an elevational view of the essential parts of a hybrid-scavengeless development system incorporating the present invention. In FIGS. 1 and 2, like reference numerals indicate like elements. The general arrangement of donor roll 40, ring 100, and electrode wire 42 in the embodiment of FIG. 2 is substantially similar to that of FIG. 1, with the further provision of a groove defined in the donor roll 40 by a section of reduced diameter 110 disposed between the ring 100 and the main portion of the donor roll 40. The purpose of the groove at the effective end of the donor roll 40 is to allow excess toner to "spill" off the edge of the donor roll 40 as needed in the development process. The advantage of providing the groove is to reduce or eliminate "edge-banding" effects which have been known to occur in any type of scavengeless development apparatus. Particularly, in the case of a donor roll 40 including a ring 100, it may be possible that excess toner may accumulate at the joint where the area of increased diameter of ring 100 meets the rest of the donor roll 42: an accumulation of unused toner in this area may for various reasons rub against the photoreceptor 10, with noticeable results on prints created with the developed photoreceptor. Ordinarily, as in the embodiment of FIG. 1, this problem can be avoided mainly by spacing the ring 100 a suitable distance from the edge of the photoreceptor 10 so accumulated toner will not rub against the photoreceptor 10. However, in the embodiment of FIG. 2, the area of reduced diameter 110 permits a further space for excess toner to escape the development zone.

Also visible in FIG. 2 is a portion of transport roll 46, which, as mentioned above, is typically in the form of a magnetic roll having carrier beads thereon, adapted to convey a quantity of toner directly from a supply sump in housing 38 to the surface of donor roll 40, thus "loading" donor roll 40 as the rolls rotate. It will be noted that one longitudinal end of transport roll 46 is disposed directly adjacent the groove formed by a section of reduced diameter 110. This feature, wherein the transport roll 46 extends slightly longer than the main portion of donor roll 40, but within the area around the groove in donor roll 40, further enhances the escape of excess toner from the development zone, thus preventing the edge banding effect. Although the end of transport roll 46 is shown in FIG. 2 as the physical end of the transport roll 46, as used in the claims herein, the "end" of the transport roll may also mean an effective end for purposes of loading the donor roll; for example the end of the transport roll may in fact extend up to the ring 100, but may also be masked, as by a plastic flange, to effectively end toward the middle of the groove, or some magnetic structure within transport roll 46 may end toward the middle of the groove.

Although, in FIGS. 1 and 2, the ring 100 and area of reduced diameter 110 of the present invention have been shown at only one end of a donor roll 40, one skilled in the art will understand that such a structure may be incorporated at both ends of such a donor roll 40, and that a transport roll 46 may be designed to extend into the groove area at both ends of a donor roll 40 such as seen in FIG. 2. Similarly, although FIGS. 1 and 2 show embodiments of the invention having a single electrode wire 42, it will be apparent that the illustrated embodiments may be adapted for use with a development station having a plurality of electrode wires.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

What is claimed is:

1. An apparatus for developing a latent image in a development zone, comprising:

a housing defining a chamber for storing a supply of developer material therein;

a donor roll, mounted at least partially in the chamber of the housing, the donor roll including a portion thereof being adapted to advance developer material to the development zone to develop the latent image, and including a region of increased diameter disposed along a length of the donor roll which is spaced from the development zone, the region of increased diameter having a diameter greater than the portion of the donor roll in the development zone; and an electrode wire positioned between the latent image and the donor roll, the electrode wire being electrically biased to detach toner particles from the donor roll so as to form a toner powder cloud in the development zone with detached toner particles from the toner cloud developing the latent image, with a portion of the electrode wire being in sliding contact with the region of increased diameter of the donor roll, whereby the electrode wire is maintained at a substantially constant spacing from the donor roll.

2. An apparatus as in claim 1, further comprising:

a transport roll mounted in the chamber of the housing and being positioned adjacent the donor roll, the transport roll being adapted to advance developer material to the donor roll.

3. An apparatus for developing a latent image in a development zone, comprising:

a housing defining a chamber for storing a supply of developer material therein;

a donor roll, mounted at least partially in the chamber of the housing, the donor roll including a portion thereof being adapted to advance developer material to the development zone to develop the latent image, a region of increased diameter spaced from the development zone, and a groove in the surface thereof between the region of increased diameter and the portion adapted to advance developer material to the development zone; and an electrode wire positioned between the latent image and the donor roll, the electrode wire being electrically biased to detach toner particles from the donor roll so as to form a toner powder cloud in the development zone with detached toner particles from the toner cloud developing the latent image, with a portion of the electrode wire being in sliding contact with the region of increased diameter of the donor roll, whereby the electrode wire is maintained at a substantially constant spacing from the donor roll.

4. An apparatus for developing a latent image in a development zone, comprising:

a housing defining a chamber for storing a supply of developer material therein;

a donor roll, mounted at least partially in the chamber of the housing, the donor roll including a portion thereof being adapted to advance developer material to the development zone to develop the latent image, and including a region of increased diameter spaced from the development zone;

an electrode wire positioned between the latent image and the donor roll, the electrode wire being electrically biased to detach toner particles from the donor roll so as to form a toner powder cloud in the development zone with detached toner particles from the toner cloud developing the latent image, with a portion of the electrode wire being in sliding contact with the region of increased diameter of the donor roll, whereby the electrode wire is maintained at a substantially constant spacing from the donor roll; and a transport roll mounted in the chamber of the housing and being positioned adjacent the donor roll, the transport roll being adapted to advance developer material to the donor roll;

wherein the donor roll defines a groove in the surface thereof between the region of increased diameter and the portion adapted to advance developer material to the development zone, with the transport roll having an end thereof disposed adjacent the groove.

5. An apparatus for developing a latent image in a development zone, comprising:

a housing defining a chamber for storing a supply of developer material therein;

a donor roll, mounted at least partially in the chamber of the housing, the donor roll including a portion thereof being adapted to advance developer material to the development zone to develop the latent image, and including a region of increased diameter spaced from the development zone;

an electrode wire positioned between the latent image and the donor roll, the electrode wire being electrically biased to detach toner particles from the donor roll so as to form a toner powder cloud in the development zone with detached toner particles from the toner cloud developing the latent image, with a portion of the electrode wire being in sliding contact with the region of increased diameter of the donor roll, whereby the electrode wire is maintained at a substantially constant spacing from the donor roll;

a transport roll mounted in the chamber of the housing and being positioned adjacent the donor roll, the transport roll being adapted to advance developer material to the donor roll; and means for applying an alternating electric field between the donor roll and the transport roll to assist in transferring at least a portion of the developer material from the transport roll to the donor roll.

6. An electrophotographic printing machine of the type having a developer unit for developing an electrostatic latent image recorded on a photoconductive surface, comprising:

a housing defining a chamber for storing a supply of developer material therein;

a donor roll, mounted at least partially in the chamber of the housing, the donor roll including a portion thereof being adapted to advance developer material to the development zone to develop the latent image, and including a region of increased diameter disposed along a length of the donor roll which is spaced from the development zone, the region of increased diameter having a diameter greater than the portion of the donor roll in the development zone; and an electrode wire positioned between the latent image and the donor roll, the electrode wire being electrically biased to detach toner particles from the donor roll so as to form a toner powder cloud in the development zone with detached toner particles from the toner cloud developing the latent image, with a portion of the electrode wire being in sliding contact with the region of increased diameter of the donor roll, whereby the electrode wire is maintained at a substantially constant spacing from the donor roll.

7. A machine as in claim 6, further comprising:

a transport roll mounted in the chamber of the housing and being positioned adjacent the donor roll, the transport roll being adapted to advance developer material to the donor roll.

8. An electrophotographic printing machine of the type having a developer unit for developing an electrostatic latent image recorded on a photoconductive surface, comprising:

a housing defining a chamber for storing a supply of developer material therein;

a donor roll, mounted at least partially in the chamber of the housing, the donor roll including a portion thereof being adapted to advance developer material to the development zone to develop the latent image, a region of increased diameter spaced from the development zone, and a groove in the surface thereof between the region of increased diameter and the portion adapted to advance developer material to the development zone; and an electrode wire positioned between the latent image and the donor roll, the electrode wire being electrically biased to detach toner particles from the donor roll so as to form a toner powder cloud in the development zone with detached toner particles from the toner cloud developing the latent image, with a portion of the electrode wire being in sliding contact with the region of increased diameter of the donor roll, whereby the electrode wire is maintained at a substantially constant spacing from the donor roll.

9. An electrographic printing machine of the type having a developer unit for developing an electrostatic latent image recorded on a photoconductive surface, comprising:

a housing defining a chamber for storing a supply of developer material therein;

a donor roll, mounted at least partially in the chamber of the housing, the donor roll including a portion thereof being adapted to advance developer material to the development zone to develop the latent image and a region of increased diameter spaced from the development zone; and an electrode wire positioned between the latent image and the donor roll, the electrode wire being electrically biased to detach toner particles from the donor roll so as to form a toner powder cloud in the development zone with detached toner particles from the toner cloud developing the latent image, with a portion of the electrode wire being in sliding contact with the region of increased diameter of the donor roll, whereby the electrode wire is maintained at a substantially constant spacing from the donor roll; and a transport roll mounted in the chamber of the housing and being positioned adjacent the donor roll, the transport roll being adapted to advance developer material to the donor roll;

wherein the donor roll defines a groove in the surface thereof between the region of increased diameter and the portion adapted to advance developer material to the development zone, with the transport roll having an end thereof disposed adjacent the groove.

10. An electrophotographic printing machine of the type having a developer unit for developing an electrostatic latent image recorded on a photoconductive surface, comprising:

a housing defining a chamber for storing a supply of developer material therein;

a donor roll, mounted at least partially in the chamber of the housing, the donor roll including a portion thereof being adapted to advance developer material to the development zone to develop the latent image and a region of increased diameter spaced from the development zone; and an electrode wire positioned between the latent image and the donor roll, the electrode wire being electrically biased to detach toner particles from the donor roll so as to form a toner powder cloud in the development zone with detached toner particles from the toner cloud developing the latent image, with a portion of the electrode wire being in sliding contact with the region of increased diameter of the donor roll, whereby the electrode wire is maintained at a substantially constant spacing from the donor roll;

a transport roll mounted in the chamber of the housing and being positioned adjacent the donor roll, the transport roll being adapted to advance developer material to the donor roll; and means for applying an alternating electric field between the donor roll and the transport roll to assist in transferring at least a portion of the developer material from the transport roll to the donor roll.

* * * * *